US010136229B2

(12) United States Patent
Swanson

(10) Patent No.: US 10,136,229 B2
(45) Date of Patent: Nov. 20, 2018

(54) BINAURAL SEGREGATION OF WIRELESS ACCESSORIES

(71) Applicant: Cochlear Limited, Macquarie University, NSW (AU)

(72) Inventor: Brett Anthony Swanson, Sydney (AU)

(73) Assignee: Cochlear Limited, Macquarie University (AU)

( * ) Notice: Subject to any disclaimer, the term of this patent is extended or adjusted under 35 U.S.C. 154(b) by 0 days.

(21) Appl. No.: 15/468,913

(22) Filed: Mar. 24, 2017

(65) Prior Publication Data

US 2018/0279059 A1 Sep. 27, 2018

(51) Int. Cl.
*H04R 25/00* (2006.01)

(52) U.S. Cl.
CPC ..... *H04R 25/552* (2013.01); *H04R 25/43* (2013.01); *H04R 25/558* (2013.01); *H04R 25/40* (2013.01); *H04R 2225/021* (2013.01); *H04R 2225/55* (2013.01)

(58) Field of Classification Search
CPC ..... H04R 25/40; H04R 25/552; H04R 25/43; H04R 25/558; H04R 2225/021; H04R 2225/55
USPC ..... 381/23.1, 312–331
See application file for complete search history.

(56) References Cited

U.S. PATENT DOCUMENTS

| | | | | |
|---|---|---|---|---|
| 7,519,194 | B2 | 4/2009 | Niederdrank | |
| 8,208,642 | B2 | 6/2012 | Edwards | |
| 8,526,648 | B2 | 9/2013 | Dijkstra | |
| 8,649,538 | B2 | 2/2014 | Apfel | |
| 8,913,753 | B2 * | 12/2014 | Cohen | H04S 1/00 381/56 |
| 9,288,584 | B2 * | 3/2016 | Hansen | H04R 25/43 |
| 9,338,565 | B2 | 5/2016 | Hansen | |
| 2007/0064959 | A1 * | 3/2007 | Boothroyd | H04R 25/405 381/92 |
| 2010/0119077 | A1 | 5/2010 | Platz et al. | |
| 2010/0128907 | A1 * | 5/2010 | Dijkstra | H04R 25/407 381/315 |
| 2010/0135500 | A1 | 6/2010 | Derleth et al. | |
| 2010/0195836 | A1 | 8/2010 | Platz | |
| 2011/0129094 | A1 | 6/2011 | Petersen | |
| 2012/0008807 | A1 * | 1/2012 | Gran | H04R 25/407 381/313 |
| 2012/0121095 | A1 * | 5/2012 | Popovski | H04R 25/552 381/23.1 |
| 2013/0202119 | A1 | 8/2013 | Thiede | |

(Continued)

FOREIGN PATENT DOCUMENTS

| | | | |
|---|---|---|---|
| EP | 2806661 | A1 | 11/2014 |
| KR | 10-1017421 | B1 | 2/2011 |

OTHER PUBLICATIONS

International Search Report and Written Opinion in counterpart International Application No. PCT/IB2018/051831, dated Jun. 29, 2018, 11 pages.

*Primary Examiner* — Disler Paul
(74) *Attorney, Agent, or Firm* — Edell, Shapiro & Finnan, LLC

(57) ABSTRACT

A binaural hearing device adapted to assist a recipient to segregate sounds from local and remote sources. Segregation can be achieved with two environmental microphones that are configured to mix right/left ambient sounds and divert them to the ear on one side of the recipient.

24 Claims, 10 Drawing Sheets

(56) References Cited

U.S. PATENT DOCUMENTS

| | | | | |
|---|---|---|---|---|
| 2014/0278383 | A1* | 9/2014 | Fan | G10L 25/84<br>704/224 |
| 2016/0183011 | A1* | 6/2016 | Gran | H04R 25/453<br>381/23.1 |
| 2016/0227332 | A1* | 8/2016 | Pedersen | H04R 25/558 |

* cited by examiner

BINAURAL SEGREGATION OF WIRELESS ACCESSORIES

TECHNICAL FIELD

The technology described herein generally relates to binaural hearing devices, and more particularly relates to methods for helping a recipient to segregate sounds from local and remote sources.

BACKGROUND

A long-standing problem for wearers of hearing aid technology is the difficulty of segregating sounds heard simultaneously from different sources. Segregation is a person's ability to focus on one sound when others—often many others—are present and may even be intrusive on one another. While people without hearing impairment have refined this ability over their lifetimes, to the point where it is second nature, those who rely on a hearing aid, particularly those who are fitted with a pair of hearing aids, are presented with a combination of sounds from which it proves difficult to separate out a source of interest from the background. It has been discovered by the hearing aid industry that many of the things that people of normal hearing do to achieve segregation, e.g., using spatial recognition, don't work as well or at all for people who rely on hearing devices. Recipients of cochlear implant technology in particular have difficulty with segregation.

The problem of poor segregation ability becomes acutely challenging in a situation when a hearing aid recipient is listening to a remote audio source such as a TV, or a classroom instructor, but where there are also significant ambient sounds from closer proximity, e.g., persons sitting next to the recipient and talking among themselves, that distract and interfere from the sound of focus. A similar situation arises when the recipient is equipped with an accessory, e.g., a wireless device such as a TV streamer or remote microphone, that is channeling audio signals from a remote source to their hearing device, but they also want to hear ambient sounds via their behind-the-ear (BTE) microphone.

It happens that mostly for people with just one hearing device (on either ear), poor segregation ability is not a primary issue with their hearing aid technology. Furthermore, due to budgetary issues, most recipients of implant technology only have a single implant. But, very few people just have deafness in one ear, which means that a pair of implants would be considerably beneficial in most cases, assuming that the concomitant problem of poor segregation can be addressed.

The problem is best illustrated by the example of a student who is a cochlear implant (CI) recipient in a classroom with a teacher who is equipped with a wireless remote microphone that communicates what she is saying to the student. But the student needs to be able to hear both the teacher and her fellow students during a classroom discussion. Mixing the signals from the teacher's microphone with the ambient signals from the rest of the classroom allows the student to hear both, but also means that classroom noise picked up by the BTE microphone is a distraction when the teacher is speaking. Thus, simply mixing the two signals together still makes it difficult to hear each one distinctly.

Accordingly, there is a need for a method and device that can process the audio inputs that the recipient's hearing devices receive, and achieve an effective segregation of remote from local sources in a manner that facilitates the recipient's perception of both sources.

The discussion of the background herein is included to explain the context of the technology. This is not to be taken as an admission that any of the material referred to was published, known, or part of the common general knowledge as at the priority date of any of the claims found appended hereto.

Throughout the description and claims of the application the word "comprise" and variations thereof, such as "comprising" and "comprises", is not intended to exclude other additives, components, integers or steps.

SUMMARY

The instant disclosure addresses binaural hearing systems that enable a wearer, or one fitted with an implant, to optimize the processing of local and remote sounds. In particular, the disclosure comprises a system that permits mixing of audio signals from local sources amongst both of the wearer's ears.

The benefits of such a system to the recipient include better sound segregation, and hence a better ability to understand speech.

The disclosure includes a binaural hearing system that has first and second hearing devices, wherein the devices are configured to receive audio signals from a remote source and audio signals from a local source, so that one of the devices can send audio signals from the local source to the other hearing device, wherein the first hearing device delivers stimulation from the remote source to one ear of a recipient, and the second hearing device delivers stimulation from the local source to the recipient's other ear.

In other respects, the present disclosure provides for a binaural hearing system, that has a first hearing device situated on or near one ear of a recipient. The first hearing device includes a first environmental microphone and a first processor configured to process audio signals from a remote source and audio signals from a first local source. The system includes a second hearing device situated on or near the recipient's other ear. The second hearing device comprises a second environmental microphone and a second processor configured to process audio signals from a second local source. The system further includes a remote microphone configured to communicate audio signals from the remote source to the first hearing device. There is also a connection between the first hearing device and the second hearing device that communicates audio signals from the first local source to the second hearing device.

BRIEF DESCRIPTION OF THE DRAWINGS

Like reference symbols in the various drawings indicate like elements.

DETAILED DESCRIPTION

The technology applies to a binaural hearing system, where the recipient is fitted with two hearing devices, one that delivers sound to their left ear, and one that delivers sound to their right ear. The two hearing devices can both be cochlear implant (CI) systems, or can both be acoustic hearing devices, or one can be a CI and the other acoustic. In a cochlear implant system, the term "delivers sound" means that the sound is processed according to a sound coding strategy, and the resulting electrical stimulation is delivered to the CI electrodes. In an acoustic hearing device, the term "delivers sound" means that the sound is processed according to an amplification scheme, and the resulting acoustic signal is delivered by an acoustic output transducer. For simplicity of writing, the following description assigns specific roles to the left and right processors, but it is understood that the two roles could be exchanged.

The technology is illustrated in the context of a wearable device, but the principles can also be applied to a recipient of totally implantable devices.

Figure 1:
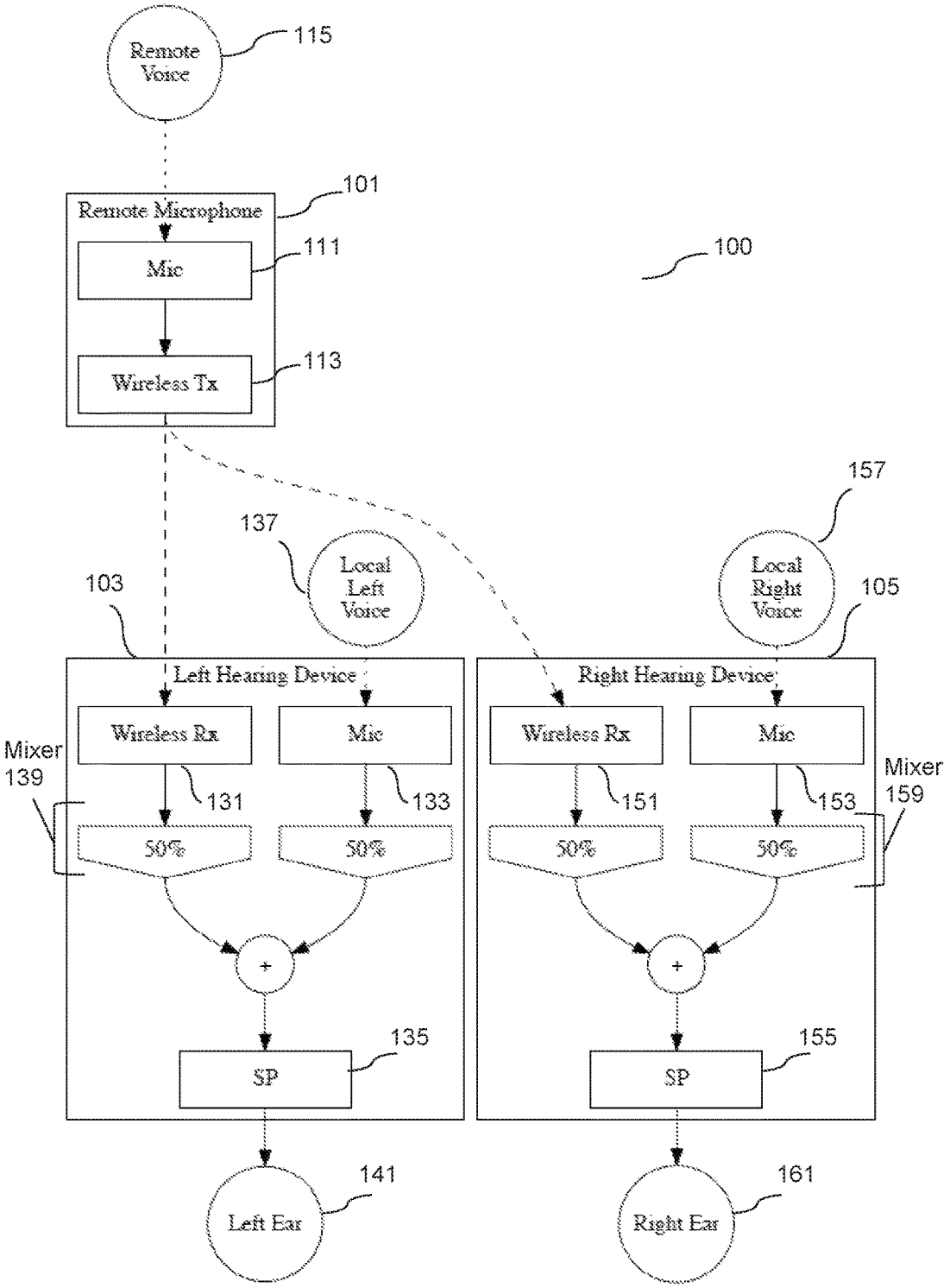
FIG. 1 shows a schematic of a binaural hearing system in which there is mixing of remote signal (such as from a wireless accessory) and local microphone signal on both sides of the recipient.

In the current state of the art, as shown in FIG. 1, if a recipient is bilateral or bimodal (is fitted with a hearing device on both ears), then typically the audio signal from a remote device 101 (such as communicating wirelessly) is streamed to both the left 103 and right 105 hearing devices, with mixing of the signal in both hearing devices.

In FIG. 1, remote device 101 comprises a remote microphone 111 ("Mic") together with associated circuitry, such as Analog-to-Digital Converter (ADC), Automatic Gain Control (AGC), and filtering (not shown). Microphone 111 receives audio input from, e.g., a remote voice 115. Device 101 further comprises a wireless signal transmission module 113 ("Wireless Tx"), which communicates an audio signal (such as from remote voice 115) to the recipient's left and right hearing devices.

Each of the left 103 and right 105 hearing devices comprises a wireless signal reception module ("Wireless Rx", 131, 151) and sound processing modules ("SP", 135, 155). In an acoustic hearing device, a sound processing module typically includes multichannel amplification. In a CI system, the sound processing module is often known as a sound coding strategy. In a totally implantable system, a receiver that is part of the implant can be configured to accept, e.g., a streaming audio signal.

Each of the left 103 and right 105 hearing devices further includes a microphone 133, 153, often referred to as a "local microphone" or an "environmental microphone" or a "behind-the-ear" (BTE) microphone, that is configured to receive audio signals 137, 157 local to the recipient. Each hearing device further includes a mixing function, 139, 159, that can mix signals from a local microphone with those received wirelessly from the remote microphone.

In the system of FIG. 1, there is mixing ("+") of the remote signal and local microphone signals on both sides of the recipient, usually in equal proportions (50% of each). This means that the recipient hears a superposition of remote signal and local left signal in his/her left ear 141 and a superposition of remote signal and local right signal in his/her right ear 161. In some embodiments, a user interface is present to allow the recipient to select which one of their two sides to exclusively deliver streaming audio from a remote microphone (other side exclusively delivers from other side environmental mic).

A problem with the arrangement of FIG. 1 is that it is difficult for the recipient to segregate the remote audio signal from the local microphone audio signals when both are heard equally in both ears. For example, in a classroom, if fellow students speak at the same time as the teacher, then the recipient student may have difficulty in hearing the teacher because both sources of sound are mixed with one another.

Figure 2:
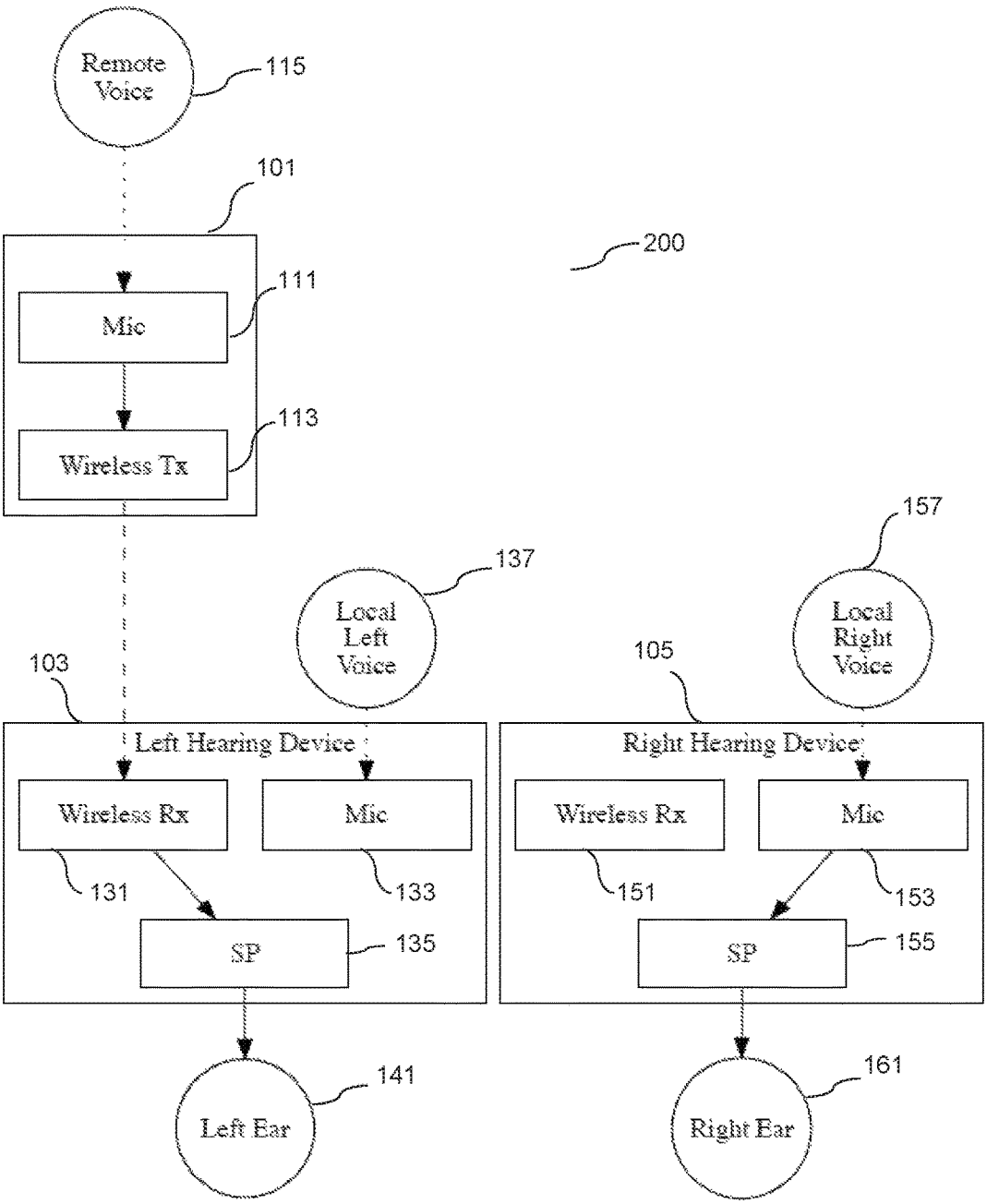
FIG. 2 shows a schematic of a binaural hearing system in which remote and local microphone signals are separated.

An alternative approach 200 is shown in FIG. 2 and may be configured in certain types of implant, such as the Nucleus 6 from Cochlear Limited. While system 200 utilizes comparable components to those used by system 100, the inputs are configured differently. In system 200, the remote audio signal, such as from remote voice 115 and processed by remote microphone 101, is streamed to only the recipient's left hearing device 103. In this configuration, there is no mixing of remote signal with local left signal 137 in the left hearing device, which means that the left ear receives a very clean remote audio signal. Conversely, the right hearing device can be configured to receive no signal from the remote audio at all; the right hearing device then only sends signal heard locally on the recipient's right side to the recipient's right ear.

Of course, in the system of FIG. 2 and with other embodiments described herein, the roles of the left and right hearing device can be exchanged with one another, without significant change to the recipient's overall experience, and without introducing additional complexity into the implementation of the technology.

The benefit of system 200 is that it is easier for the recipient to segregate two audio signals (e.g., from a remote source such as a teacher's voice, and more proximate fellow students' voices) when they are presented to different ears. However, one problem with this arrangement is that the local (such as BTE) microphone of the left hearing device is not used, and thus the recipient may have difficulty hearing ambient sound from the left side, and indeed will have an incomplete perception of sounds in their proximity.

According to the technology presented herein, there are at least three (3) related ways to achieve a better level of segregation by the recipient and to assist a recipient who needs to divide attention between signals. In principle, each way provides an optimal listening environment to each ear.

Figure 3:
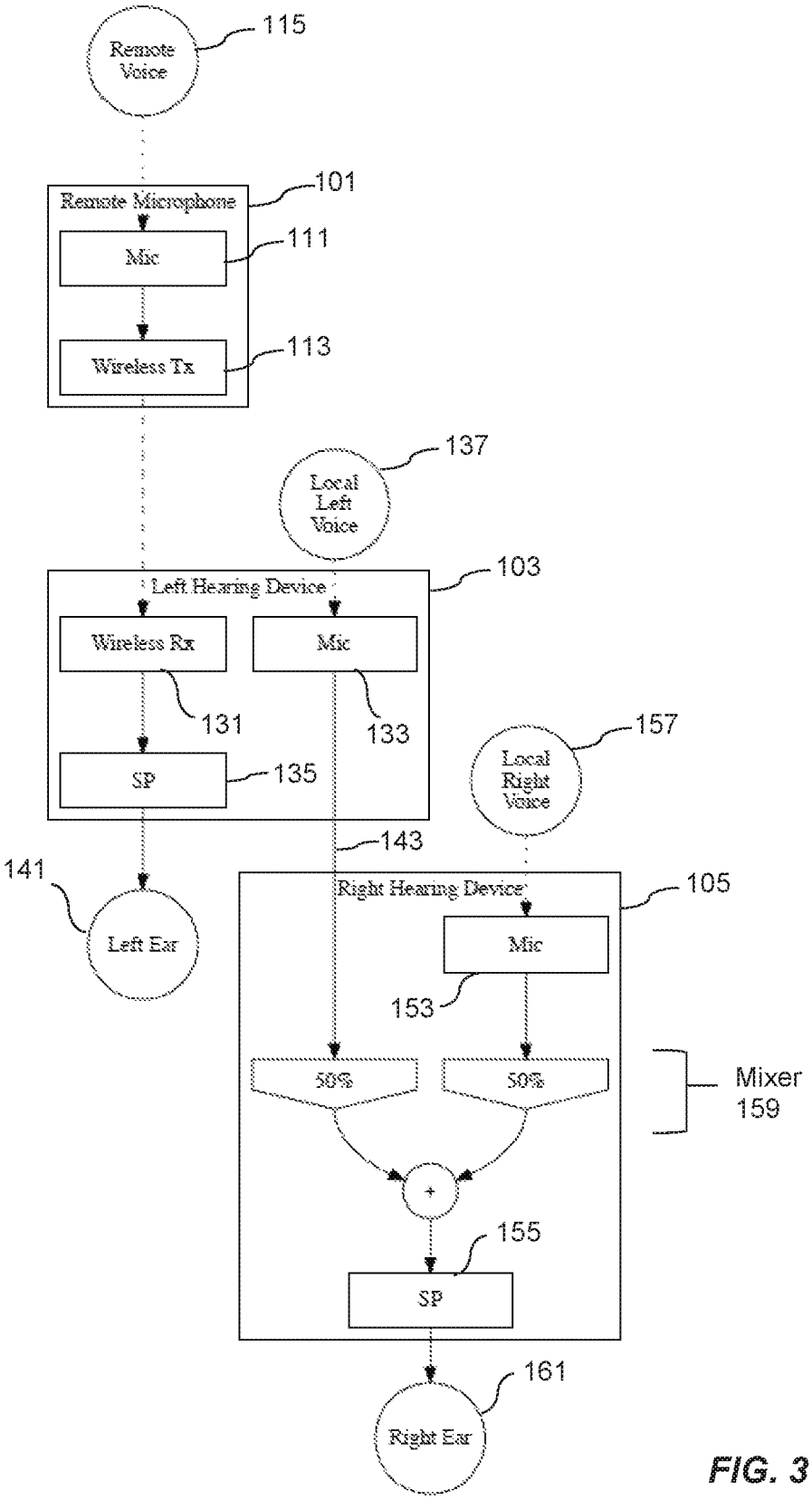
FIG. 3 shows a system configured to carry out cross mixing, with a wired connection between first and second hearing devices.
Figure 4:
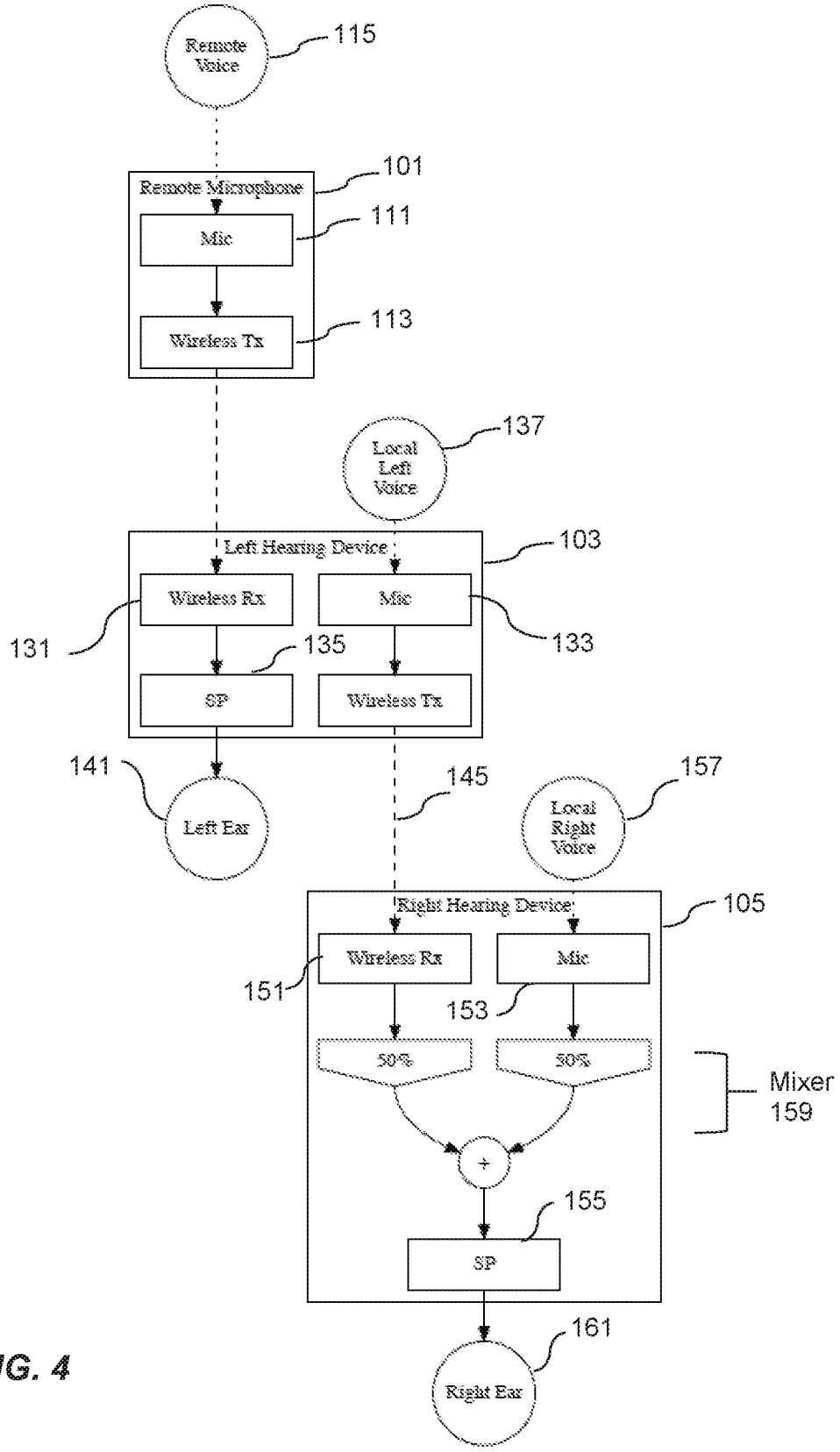
FIG. 4: shows a system configured to carry out cross mixing, with a wireless connection between first and second hearing devices.

In one embodiment, FIGS. 3 and 4, referred to as "cross mixing", the remote microphone output is diverted to the hearing device on one ear (the recipient's left ear 141, as shown), and the outputs from both left and right BTE's are diverted to the hearing device on the other ear (right ear 161 as shown). In the embodiment of FIG. 3, the signal from the left hearing device is sent via a wired connection 143 to the right hearing device 105 and mixed directly with the local signal at the right hearing device. Preferably, the microphone audio from the left hearing device is sent to the right hearing device by a wireless streaming connection 145, as shown in FIG. 4, in which case the left hearing device 103 is equipped with a wireless transmitter 132 that communicates the signal from the left local voice to the wireless receiver 151 in the right hearing device 105. In the embodiment shown in FIGS. 3 and 4, the signals from local left and local right sources are mixed together in equal parts (50:50), but it would be understood that the ratio could take other values and in preferred embodiments could be adjustable by the recipient, as further described herein.

In this embodiment, the signal delivered to the left ear has a high target-to-masker ratio (TMR) for remote audio as target, while the right ear has a high TMR when considering the local audio as the target. This embodiment is an improvement over the system of FIG. 2, because all of the available signals are channeled to one or other of the recipient's ears, and there is no switch off for either left or right local microphones.

Thus, in the embodiments of FIGS. 3 and 4, the left hearing device delivers only wireless audio to the recipient's left ear, and the right hearing device delivers a mixture of the left and right BTE microphone audio to the recipient's right ear. For example, this configuration allows a student fitted with the device to hear her teacher's remote microphone in her left ear, and to hear fellow students in her right ear, regardless of whether the students are sitting on her left side or her right side.

One drawback of this embodiment is that some of the teacher's voice reaches the student's right hearing device by air conduction, thus compromising the principle of pure separation of signals between the ears.

Figure 5:
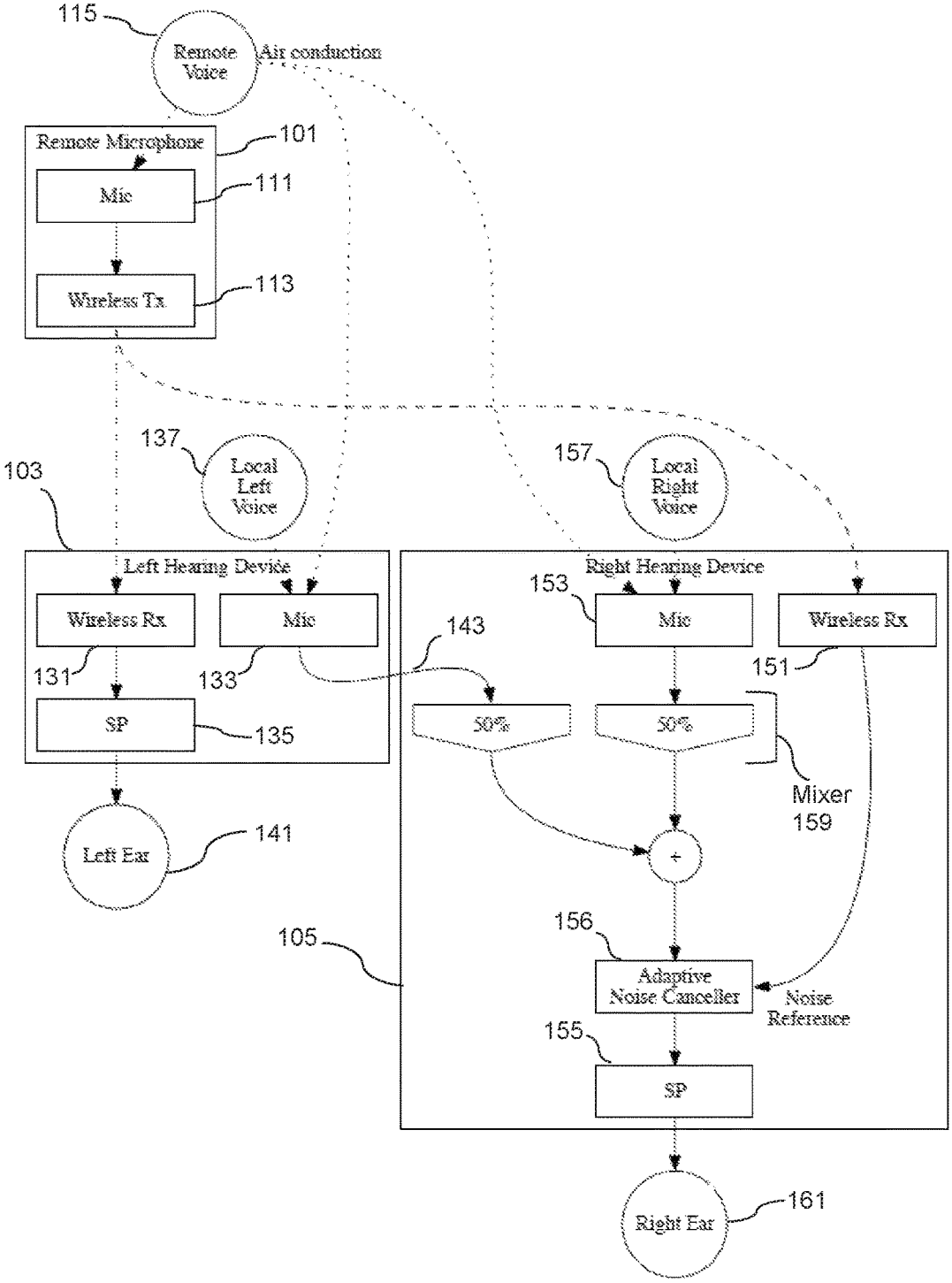
FIG. 5: Using adaptive noise cancelling to remove air-conducted remote voice from summed local microphone signals, with a wired connection between first and second hearing devices.

Another embodiment of the technology, FIG. 5, mitigates this drawback by applying noise cancelling techniques. Both the left and right hearing devices receive the remote wireless audio, but the right hearing device does not provide the remote wireless audio directly to its sound processing module. Instead, the right hearing device uses the remote wireless audio as a "noise reference" for adaptive noise canceller 156, and thereby is able to remove the air-conducted sound of the teacher's voice from the sum of the local microphone signals that is diverted to the right sound processing module. The local microphone signals from left and right hearing devices are mixed at the right hearing device and channeled to the recipient's right ear. The result is that the recipient, say a student in a classroom, hears her teacher's voice (from the remote microphone) only in her left ear, and only her fellow students' voices in her right ear.

Figure 6:
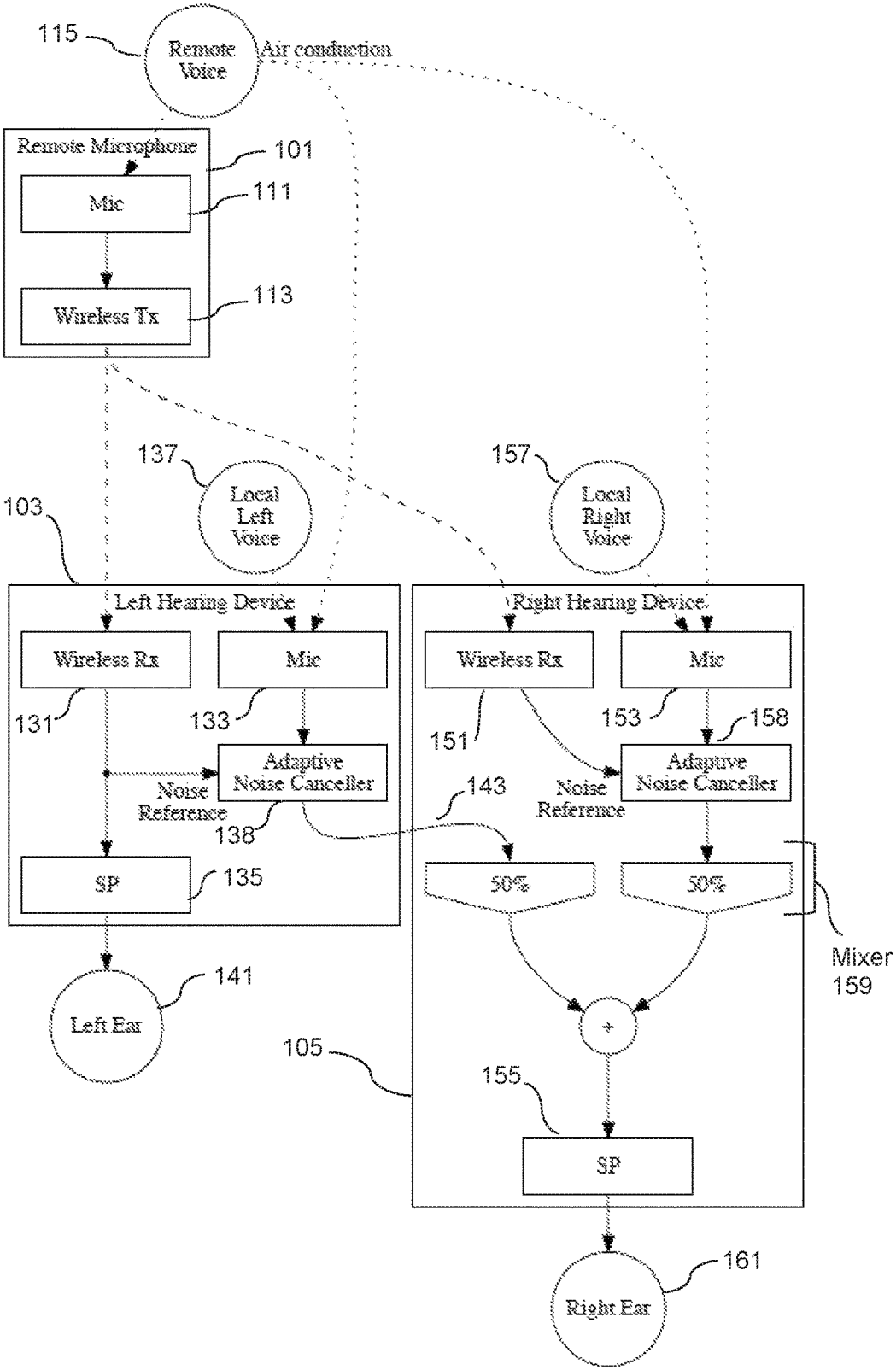
FIG. 6: Using adaptive noise cancelling to remove air-conducted remote voice from each local microphone signal individually, with a wired connection between first and second hearing devices.

In another embodiment, FIG. 6, referred to herein as "Remote Mic as Noise Reference", the inputs can be configured so that one ear has a high TMR for the remote audio as target, and the other ear has a high TMR for the local audio as target. In this embodiment, the left hearing device has an adaptive noise canceller 138 to remove the air-conducted remote voice from the left local microphone signal, and the right hearing device has an adaptive noise canceller 158 to remove the air-conducted remote voice from the right local microphone signal. The outputs from the respective left and right adaptive noise cancellers are mixed (in a 1:1 ratio as shown) and subsequently delivered to the right ear. In the embodiment of FIG. 6, a wired connection 143 transmits signal from the left to the right hearing devices. Alternatively (not shown), a wireless connection could be used to accomplish this, as with other embodiments described herein.

Figure 7:
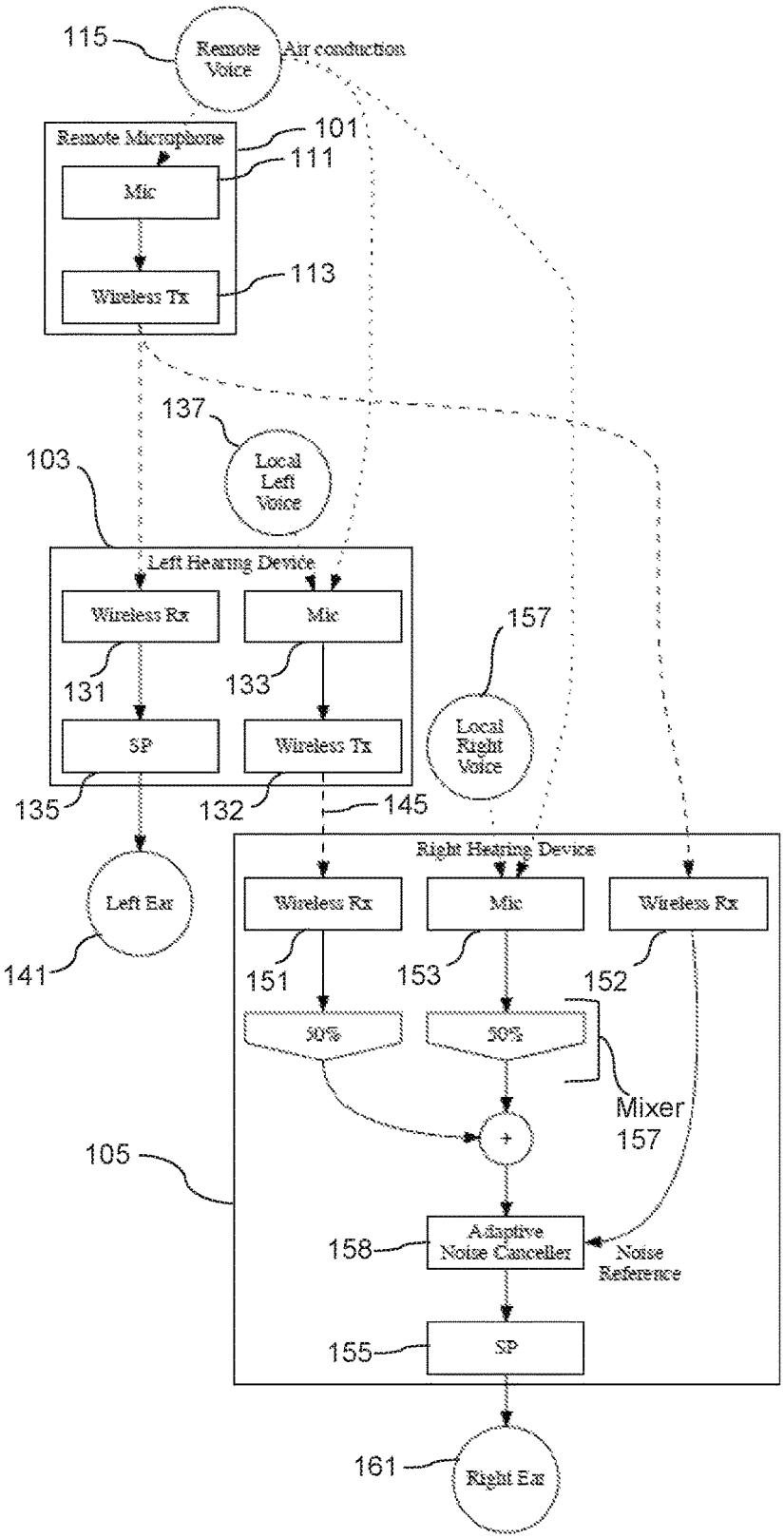
FIG. 7: Using adaptive noise cancelling to remove air-conducted remote voice from local microphone signal, with a wireless connection between first and second hearing devices.

Another embodiment of the invention that adds an adaptive noise canceller to the embodiment of FIG. 4 is shown in FIG. 7. The embodiment in FIG. 7 is also a version of the embodiment of FIG. 5 in which a wireless transmitter communicates the signal from left to right hearing devices.

The embodiments in FIGS. 5, 6 and 7 remove the air-conducted sound of the remote audio from the local microphone signals. In the classroom example, the result is that the student hears the teacher's voice only in her left ear, and only her fellow students' voices in her right ear.

Figure 8:
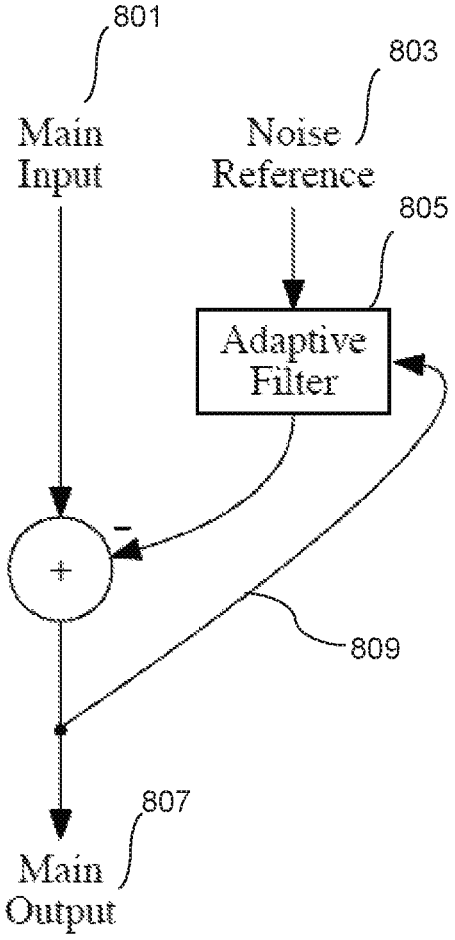
FIG. 8: a schematic of an exemplary adaptive noise canceller.

One suitable adaptive noise canceller for use with the technology herein is shown in FIG. 8. The main input 801 is a mixture of a desired signal and a first interference signal. The noise reference 803 is a second interference signal, which is correlated with the first interference signal. The noise reference is applied to an adaptive filter 805. The output of the adaptive filter is subtracted from main input 801, giving a main output 807 that has reduced interference. The main output 801 is fed back 809 to adaptive filter 805 as an error signal, and the adaptive algorithm operates to minimize the error power. Implementations of an adaptive filter suitable for application herein are described in, for example, Haykin, S. O., *Adaptive Filter Theory* (5th edition), Pearson, (2013).

Figure 9:
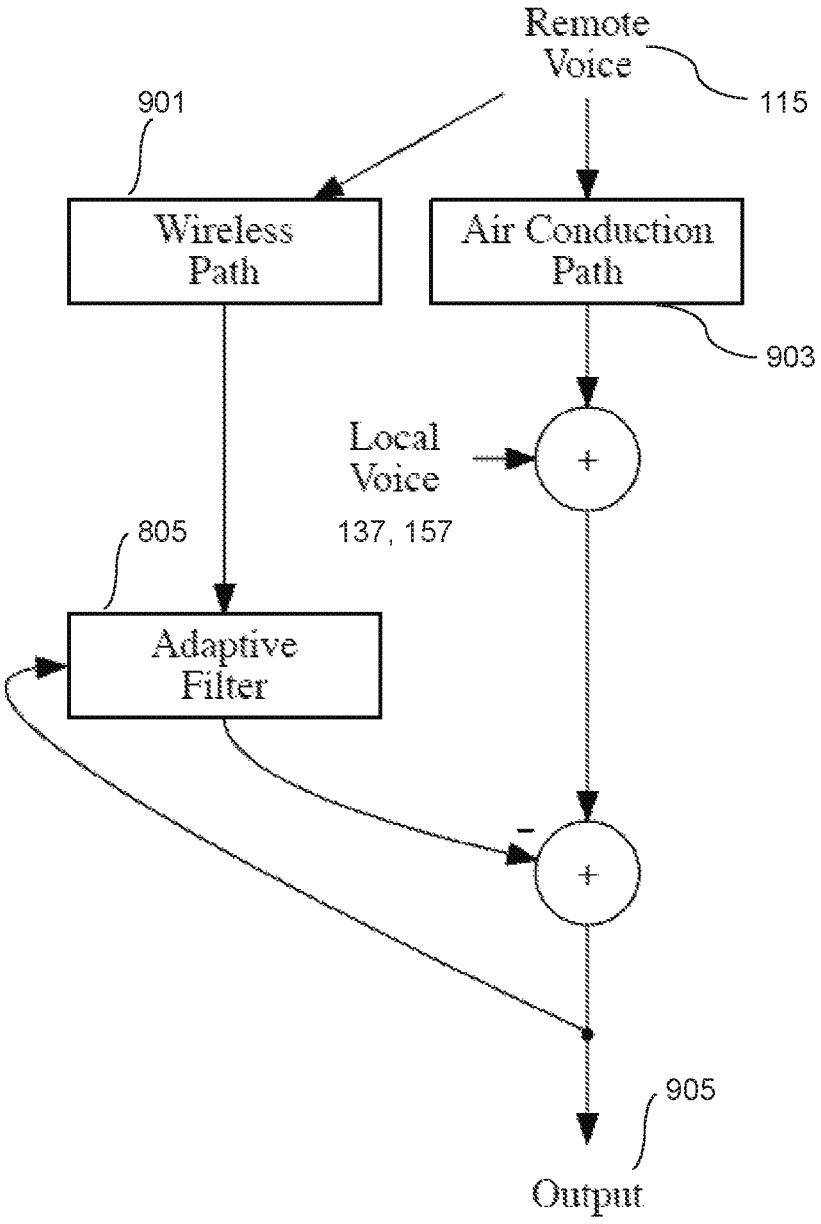
FIG. 9: Signal processing using adaptive noise cancelling.

FIG. 9 shows a simplified diagram of the signal processing pathway of the embodiments herein that utilize an adaptive noise canceller. The adaptive filter adapts so that the cascade of the transfer functions of the wireless path 901, and the adaptive filter 805 is substantially equivalent to the transfer function of the air conduction path 903. Output 905 can be directed to a sound processing unit (not shown in FIG. 9).

In one embodiment, the system includes a user interface that allows the user to easily configure their system so that the left hearing device delivers the wireless audio without the environmental microphone audio, and the right hearing device delivers the environmental microphone audio without wireless audio, thus aiding segregation of the two audio signals. Such an interface can be implemented in, e.g., a handheld device such as a mobile phone or tablet, or can be integrated within the system, such as in the form of a push-button control unit.

Figure 10:
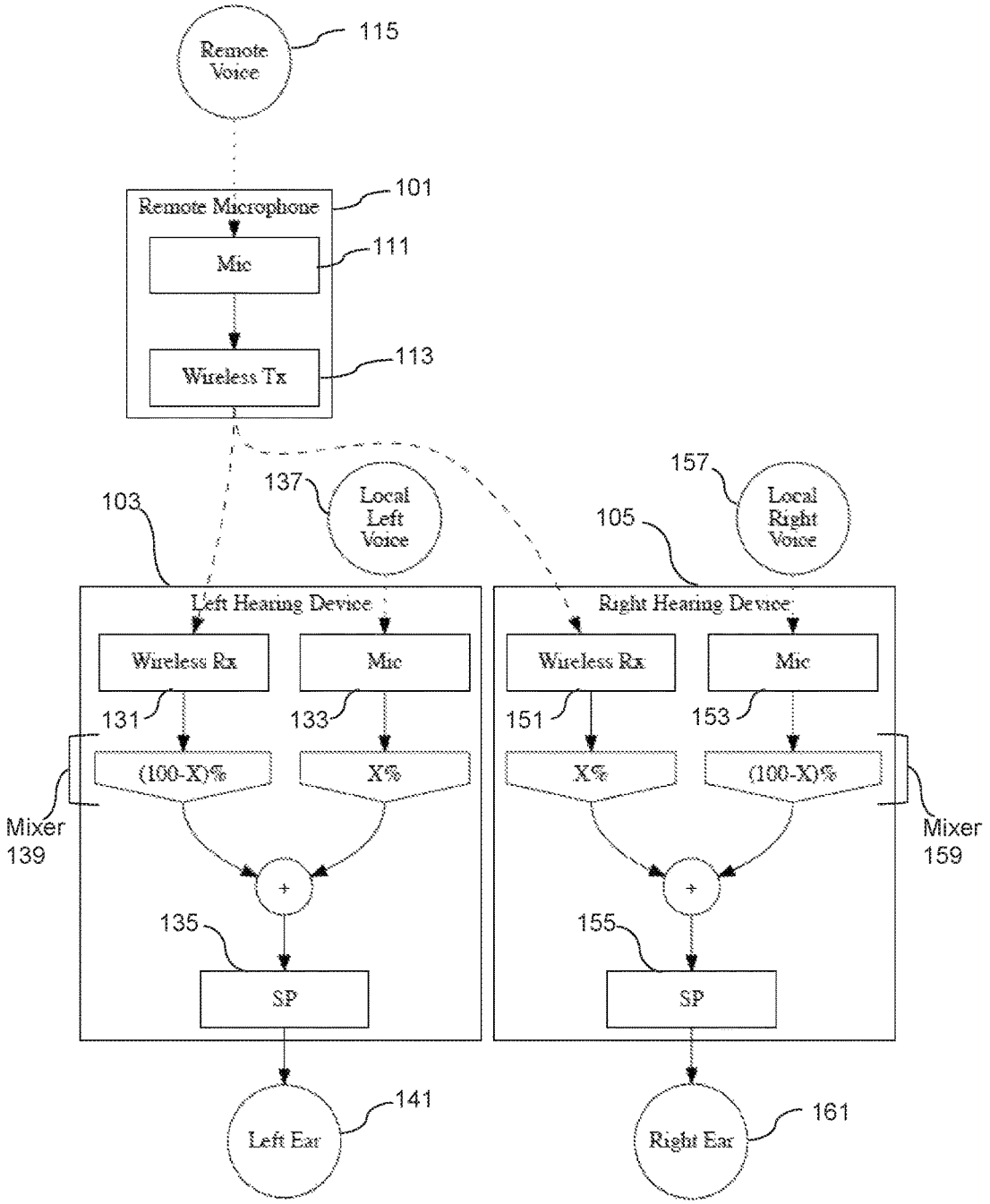
FIG. 10 illustrates complementary mixing of remote signal (such as from a wireless accessory) and local microphone signal on both sides of the recipient.

FIG. 10 demonstrates "complementary mixing", a way to provide adjustable mixing to optimize what a recipient hears in each ear. This approach might be realized in other ways such as with a balance control for a remote microphone and a separate balance control for one or both BTE's. In one embodiment of the scheme of FIG. 10, a user interface provides a mixing control (e.g., a slider) that affects the two hearing devices in a complementary fashion: i.e., the left hearing device delivers (100−X)% wireless audio and X % BTE microphone audio, whereas the right hearing device delivers X % wireless audio and (100−X)% BTE microphone audio, with the parameter X being controlled by the user on a scale from 0 to 100. At one extreme of the scale, X=0, the left hearing device delivers only wireless audio and no BTE microphone audio, and the right hearing device delivers no wireless audio and only BTE microphone audio. At the other extreme, X=100, the left hearing device delivers no wireless audio and only BTE microphone audio, and the right hearing device delivers only wireless audio and no BTE microphone audio. At the middle of the scale, X=50, both hearing devices receive 50% wireless audio and 50% BTE microphone audio.

The proportions of signal mix/match on both sides can be adjusted by the user. Some pre-programmed preferred ratios and settings can also be provided. For example:

| | | | |
|---|---|---|---|
| Left (L) | 80% Remote Mic | 10% L BTE Mic | 10% R BTE Mic |
| Right (R) | 20% Remote Mic | 80% L BTE Mic | |

The embodiment of FIG. 10 can also benefit from automation. One major category of target users are children, who won't necessarily be able to adjust the mixing to find the optimal one in short order.

Other Implementational Details

In some embodiments, the hearing system is equipped with a user interface through which a recipient can control certain aspects of the system function. For example, the recipient can achieve a desired level of mixing of signals in first and second hearing devices with a button or similar control on the device.

In some embodiments, the interface is via a wireless device such as a mobile phone with a suitably tailored interface on the same. In other embodiments, a specially dedicated remote control can be provided.

In some embodiments, the device can be configured to work with a source of streaming audio content such as a TV, instead of a remote microphone.

The technology described herein can be adapted to work with any type of hearing device that is fitted binaurally. Such devices include audio-prostheses generally, such as acoustic hearing aids and cochlear implants. The devices include those that function via bone conduction, those that work in the middle ear, and various combinations of such hearing device types.

The instructions for processing audio signals can be implemented in firmware (such as in a DSP chip in an audio-prosthesis). Thus, for example, such instructions include instructions for receiving signals, selecting appropriate signals, mixing them according to a set ratio, and deliver sound to the recipient's ears.

Typically, two hearing aids do not communicate directly with one another. Accordingly, in the present technology, a way of communicating a signal, such as a mixed signal, from the hearing device on one side of the recipient's head to the counterpart hearing device on the other side, is built into the device. Thus, for example, the processing of signals (including the mixing and noise cancellation as applicable and as described elsewhere herein), can be carried out in the device on one ear and combined with the signals measured by the device on the recipient's other ear.

The technology herein is also compatible with recent cochlear implant systems and other hearing devices that are worn off the ear. Such devices still have a right and a left side but are not actually worn behind the recipient's ear. Nevertheless, such off the ear devices include an "environmental" microphone.

All references cited herein are incorporated by reference in their entireties.

The foregoing description is intended to illustrate various aspects of the instant technology. It is not intended that the examples presented herein limit the scope of the appended claims. The invention now being fully described, it will be apparent to one of ordinary skill in the art that many changes and modifications can be made thereto without departing from the scope of the appended claims.

What is claimed:

1. A binaural hearing system, comprising:

a second hearing device;

a first hearing device configured to:

receive audio signals from a remote source;

receive audio signals from at least one local source, send only the audio signals received from the at least one local source to the second hearing device, and deliver, to a first ear of the recipient, stimulation that represents only the audio signals received from the remote source, wherein the second hearing device delivers, to a second ear of the recipient, stimulation that represents the audio signals received from the at least one local source at first hearing device.

2. The system of claim 1, wherein the second hearing device is configured to independently receive audio signals from one or more local sources, and wherein the second hearing device is configured to mix the audio signals received from the first hearing device with the independently received audio signals from the one or more local sources.

3. The system of claim 1, wherein the first hearing device is configured to wirelessly send the audio signals received from the at least one local source to the second hearing device.

4. The system of claim 1, wherein the first hearing device comprises:

a first microphone configured to receive the audio signals from at least one local source and air-conducted sound from the remote source; and a first adaptive noise canceller configured to remove the air-conducted sound received by the first microphone from the remote source.

5. The system of claim 1, wherein the second hearing device comprises:

a second microphone configured to receive audio signals from at least one local source and air-conducted sound from the remote source; and a second adaptive noise canceller configured to remove the air-conducted sound received by the second microphone from the remote source.

6. The system of claim 1, wherein one or both of the first and second hearing devices is a cochlear implant, and delivers sound via electrical stimulation of a cochlear implanted electrode.

7. The system of claim 1, wherein one or both of the first and second hearing devices is an acoustic hearing device, and delivers sound via an acoustic output transducer.

8. The system of claim 1, wherein the remote source is a human voice spoken into a remote microphone.

9. The system of claim 1, wherein the remote source is an item of audio or audio-visual equipment.

10. A binaural hearing system, comprising:

a first hearing device coupled to a first ear of a recipient, wherein the first hearing device comprises a first environmental microphone configured to receive audio signals from a first local source, a wireless receiver configured to receive audio signals from a remote source, and a first processor configured to process the audio signals received from the remote source for delivery of first sounds to the first ear of the recipient, wherein the first sounds are based only on the audio signal received from the remote source;

a second hearing device coupled to a second ear of the recipient, wherein the second hearing device comprises a second environmental microphone configured to receive audio signals from a second local source, and a second sound processor;

a remote microphone configured to communicate audio signals from the remote source to the wireless receiver in the first hearing device; and a connection between the first hearing device and the second hearing device that communicates the audio signals received by the first environmental microphone from the first local source to the second hearing device, wherein the second hearing device mixes the audio signals received from the first local source with the audio signals received from the second local source and delivers the mixed signals to the second sound processor for delivery of second sounds to the second ear of the recipient.

11. The system of claim 10, wherein the first and second hearing devices each comprise one of: an acoustic hearing device; a cochlear implant; a bone conduction implants device; and a middle ear implant.

12. The system of claim 10, wherein the second hearing device includes an input enabling a recipient to control a proportion of the audio signals from the first local source that is delivered to the second ear.

13. The system of claim 12, wherein the input enabling the recipient to control the proportion of the audio signals from the first local source that is delivered to the second ear comprising an input configured to receive instructions from an additional device selected from a group comprising: mobile phone; and hand-held remote control unit.

14. The system of claim 12, wherein the recipient can control the proportion of the audio signals from the first local source that is delivered to the second ear by actuating a control feature on one of the hearing devices.

15. The system of claim 10, wherein the remote source is a human voice.

16. The system of claim 10, wherein the remote source is a streaming audio signal.

17. The system of claim 10 wherein one or both of the first environmental microphone and the second environmental microphone is a behind-the-ear microphone.

18. The system of claim 10, wherein the first environmental microphone is configured to receive air-conducted sound from the remote source, and wherein the first hearing device comprises a first adaptive noise canceller configured to remove the air-conducted sound received by the first environmental microphone from the remote source.

19. A method of improving a hearing device recipient's ability to segregate aural inputs, the method comprising:

receiving audio signals from a remote source at a first hearing device which delivers sound to a first ear of the recipient;

receiving, at the first hearing device, audio signals from at least one local source;

sending only the audio signals received from the at least one local source to a second hearing device;

delivering, at the first hearing device, sound to the recipient's first ear based only on the audio signals from a remote source;

receiving, at the second hearing device, audio signals from one or more local sources;

mixing the audio signals from the at least one local source received by the first hearing device with the audio signals from the one or more local sources received by the second hearing device; and delivering sound to the recipient's second ear based on the mix of the audio signals from the at least one local source received by the first hearing device with the audio signals from the one or more local sources.

20. The method of claim 19 wherein the one or more local sources overlap with the at least one local source.

21. The method of claim 20 wherein the remote source is an item of audiovisual equipment.

22. The method of claim 19 wherein the mixing comprises streaming all of the audio signals from the at least one local source received by the first hearing device to the second hearing device.

23. The method of claim 22 wherein the streaming comprises wirelessly streaming all of the audio signals from the at least one local source.

24. The method of claim 23 wherein the streaming comprises streaming all of the audio signals from the at least one local source via a wired connection between the first hearing device and the second hearing device.

* * * * *